US008317545B2

(12) United States Patent
Iida

(10) Patent No.: US 8,317,545 B2
(45) Date of Patent: Nov. 27, 2012

(54) ELECTRIC CONNECTOR PLUG AND ITS ASSEMBLY METHOD

(75) Inventor: Takashi Iida, Aichi (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 1855 days.

(21) Appl. No.: 10/499,907

(22) PCT Filed: Dec. 19, 2002

(86) PCT No.: PCT/JP02/13327
§ 371 (c)(1),
(2), (4) Date: Jun. 22, 2004

(87) PCT Pub. No.: WO03/058767
PCT Pub. Date: Jul. 17, 2003

(65) Prior Publication Data

US 2005/0048843 A1 Mar. 3, 2005

(30) Foreign Application Priority Data

Dec. 31, 2001 (JP) ..... 2001-403242

(51) Int. Cl.
*H01R 13/66* (2006.01)

(52) U.S. Cl. ..... 439/620.15; 439/352

(58) Field of Classification Search ..... 439/620, 439/352, 357, 188, 489, 454, 466
See application file for complete search history.

(56) References Cited

U.S. PATENT DOCUMENTS 5,275,575 A 1/1994 Cahaly et al. ..... 439/188
5,314,345 A * 5/1994 Cahaly et al. ..... 439/188
5,586,902 A * 12/1996 Hopf et al. ..... 439/352
5,647,757 A * 7/1997 Chrysostomou ..... 439/352
6,019,638 A * 2/2000 Saka et al. ..... 439/620
6,217,388 B1 * 4/2001 Francis ..... 439/620
6,283,794 B1 9/2001 Osuga ..... 439/620

(Continued)

FOREIGN PATENT DOCUMENTS

DE 4317344 A1 12/1994

(Continued)

OTHER PUBLICATIONS

Japanese Notice of Ground of Rejection issued on Appl. No. 2001-403242; Dated Feb. 20, 2006; (2 pages).
English Translation of Japanese Notice of Ground of Rejection issued on Appl. No. 2001-403242; Dated Feb. 20, 2006; (2 pages).

(Continued)

*Primary Examiner* — Hien Vu
(74) *Attorney, Agent, or Firm* — Osha Liang LLP

(57) ABSTRACT

A plug for electric connectors comprises a housing 34 and a cap 36. The housing 34 comprises an insertion space 71 that allows a noise filter 35 to be fitted onto lengths of electric wire 32 before the housing is covered by the cap 36 after contacts 30 are latched. The cap 36 comprises a wall surface 75 provided in a direction, in which the noise filter 35 comes off. And, the plug for electric connectors is assembled in the order of (1) a step of latching the contacts 30 on a plug portion 31*a* of the housing 34, (2) a step of fitting the noise filter 35 onto the lengths of electric wire 32 that are connected to the contacts 30 and disposed within the housing 34, and (3) a step of covering the housing 34 with the cap 36 and forming a wall surface 72 in a direction, in which the noise filter 35 comes off.

2 Claims, 13 Drawing Sheets

U.S. PATENT DOCUMENTS 6,461,184 B2 * 10/2002 Nimura ..... 439/352

FOREIGN PATENT DOCUMENTS

| | | | |
|---|---|---|---|
| EP | 0 591 947 | A2 | 4/1994 |
| EP | 1150389 | A1 | 10/2001 |
| JP | 4-14777 | | 1/1992 |
| JP | 5-159836 | | 6/1993 |
| JP | 2647336 | B2 | 5/1997 |
| JP | 11-283691 | A | 10/1999 |
| JP | 2001-196142 | | 7/2001 |
| JP | P2001-319747 | A | 11/2001 |
| JP | P2002-033153 | A | 1/2002 |

OTHER PUBLICATIONS

Patent Abstracts of Japan, English Translation of Japanese Publication No. 2001-319747; Dated Nov. 16, 2001; (2 pages).

Patent Abstracts of Japan, English Translation of Japanese Publication No. 2002-033153; Dated Jan. 31, 2002; (2 pages).

Patent Abstracts of Japan, English Translation of Japanese Publication No. 11-283691; Dated Oct. 15, 1999; (2 pages).

English Translation of Japanese Patent No. 2647336; Dated May 9, 1997; (16 pages).

Office Action Issued in European Patent Application No. 02806066.3, Dated Dec. 12, 2011 (8 Pages).

* cited by examiner

ELECTRIC CONNECTOR PLUG AND ITS ASSEMBLY METHOD

TECHNICAL FIELD

The invention relates to a plug for electric connectors, in which a connection part in a state with a noise filter fitted onto lengths of electric wire connected to contacts is received in a housing and a cap, and a method of assembling the same. In particular, the invention relates to a plug for electric connectors, which simply and surely enables positioning contacts and a noise filter in a housing, and a method of assembling the same.

BACKGROUND ART

This type of electric connector is suitably used for electric connectors in an airbag system. An airbag system comprises an airbag assembly mounted in a hidden compartment within a driver's cabin of a vehicle, and an electric type or electronic type control system. The control system is connected to the airbag assembly by means of a wire harness. Provided on the wire harness is an electric connector comprising a typical plug and a socket so as to allow an easy method for electric connection of an airbag assembly and a control system after these elements are separately mounted.

FIG. 13 is a view schematically and electrically showing a conventional, typical airbag system. In FIG. 13, a control system 100 is connected through lengths of electric wire 102 to a squib 101 being an ignition device that sends an electric current to a gas generator for development of an airbag in an airbag assembly (not shown). Such connection is achieved by an electric connector 103 that comprises a socket 104 and a plug 105. For example, U.S. Pat. No. 5,275,575 and Japanese Patent No. 2647336 disclose concrete examples of an electric connector applied on an airbag system.

Here, in an electric connector 103, a short-circuit insert 107 is mounted on a socket 104 to be able to short-circuit between a pair of lengths of electric wire connected to the squib 101. A ferrite bead 106 is arranged on the plug 105 while being fitted onto the lengths of electric wire 102 leading to contacts 108. The short-circuit insert 107 is provided as a safety device so as to prevent an airbag assembly from being actuated due to leaking static charge in manufacture and misconnection. The short-circuit insert is constructed to be able to switch between a short-circuit position and a non-short-circuit position. And, the ferrite bead 106 functions as a noise filter to prevent explosion by mistake in an airbag system built in a vehicle when a noise current flows through the squib 101 due to various electromagnetic waves from an outside such as lengths of electric wire, various electronic equipment, radio receiver, portable telephone, etc. in a vehicle.

The plug 105 is constructed with the contacts 108 and the ferrite bead 106 received in a housing 109 and a cap 110. In assembling the plug 105, the connection part is formed by fitting the ferrite bead 106 onto a pair of lengths of electric wire 102 after the contacts 108 and the lengths of electric wire 102 are connected in a L-shaped manner to each other. Next, the connection part comprising the contacts 108 and the ferrite bead 106 are received and positioned in the housing 109. Then, the housing 109 is covered by the cap 110 to form the plug 105.

However, positioning of both the contacts 108 and the ferrite bead 106 of the connection part in the housing 109 is performed at a time. At this time, positioning is performed while a distance from the contacts 108 to the ferrite bead 106 is maintained at a predetermined magnitude. Therefore, there is involved a problem that an operation of mounting the contacts 108 and the ferrite bead 106 as the connection part to the housing 109 becomes difficult.

The invention has been thought of in view of the above situation and has its object to provide a plug for electric connectors, of which an assembling operation can be simply and surely performed, and a method of assembling the same.

DISCLOSURE OF THE INVENTION

A plug for electric connectors, which solves the above problems, comprises a connection part formed by connecting contacts and lengths of electric wire to each other and fitting a noise filter onto the lengths of electric wire, a housing provided with a plug portion, which projects therefrom and to which the contacts are latched, the housing receiving the noise filter, and a cap that covers the housing. The housing comprising an insertion space to afford fitting the noise filter onto the lengths of electric wire before being covered by the cap after the contacts are latched thereon. Also, the cap is structured to have a wall surface in a direction, in which the noise filter comes off.

A method of assembling a plug for electric connectors, which solves the above problems, comprises the steps of (1) latching the contacts on the plug portion of the housing,
(2) fitting the noise filter onto the lengths of electric wire that are connected to the contacts and disposed within the housing, and
(3) covering the housing with the cap and forming a wall surface in a direction, in which the noise filter comes off.

According to the plug for electric connectors, and the method of assembling the same, the noise filter is positioned in a predetermined position in the housing by latching the contacts on the plug portion of the housing, and fitting the noise filter onto the lengths of electric wire that are connected to the contacts. Fitting the noise filter onto the lengths of electric wire and positioning of the noise filter in the housing can be effected at the same time. Further, when the housing is covered by the cap, a wall surface is formed in a direction, in which the noise filter comes off, so that the noise filter is fixed in a predetermined position.

In the plug for electric connectors, constructed in the above manner, it is preferable that means for preventing coming-off of the noise filter be provided in the insertion space of the housing. A state, in which the noise filter is inserted into the housing, is kept by the coming-off preventing means. As a result, the noise filter is not offset in position until the housing is covered by the cap.

In the plug for electric connectors, constructed in the above manner, it is preferable that a front surface of the noise filter on an insertion side be shaped to be reduced in diameter. When the noise filter is inserted into the insertion space of the housing, the small-diameter shaped portion is first inserted. As a result, the noise filter becomes easy to be inserted into the insertion space.

In the plug for electric connectors, constructed in the above manner, it is preferable that ribs be provided in the insertion space of the housing to abut against sides of the noise filter. After the noise filter is inserted into the insertion space of the housing, the ribs abut against the noise filter. Therefore, the noise filter is not moved in the insertion space whereby generation of abnormal noise due to rattling of the noise filter is eliminated.

In a further plug for electric connectors, constructed in the above manner, a plug for electric connectors, comprises a connection part, in which contacts and lengths of electric wire are connected to each other and a noise filter is fitted onto the lengths of electric wire, a housing provided with a plug portion, which projects therefrom and to which the contacts are latched, the housing receiving the noise filter, and a cap that covers the housing. The cap comprising a temporary latch portion for the contacts and an insertion space to afford fitting the noise filter onto the lengths of electric wire before covering the housing. Also, the housing comprises a wall surface in a direction, in which the noise filter comes off, being formed when the contacts are latched on the plug portion.

A method of assembling a further plug for electric connectors, which solves the above problems, comprises the steps of (1) temporarily latching the contacts on the cap, (2) fitting the noise filter onto the lengths of electric wire that are connected to the contacts and disposed on a side of the cap, and (3) covering the housing with the cap, to which the connection part is fixed, latching the contacts on the plug portion of the housing, and forming a wall surface in a direction, in which the noise filter comes off.

According to the further plug for electric connectors, and the method of assembling the same, the noise filter is positioned in a predetermined position relative to the cap by temporarily latching the contacts on the cap and fitting the noise filter onto the lengths of electric wire that are connected to the contacts. Further, when the housing is covered by the cap, the contacts are latched on the plug portion. At the same time, a wall surface is formed in a direction, in which the noise filter comes off, and the noise filter is fixed in a predetermined position. In this manner, fitting the noise filter onto the lengths of electric wire and positioning the noise filter can be performed at the same time.

BEST MODE FOR CARRYING OUT THE INVENTION

Figure 1:
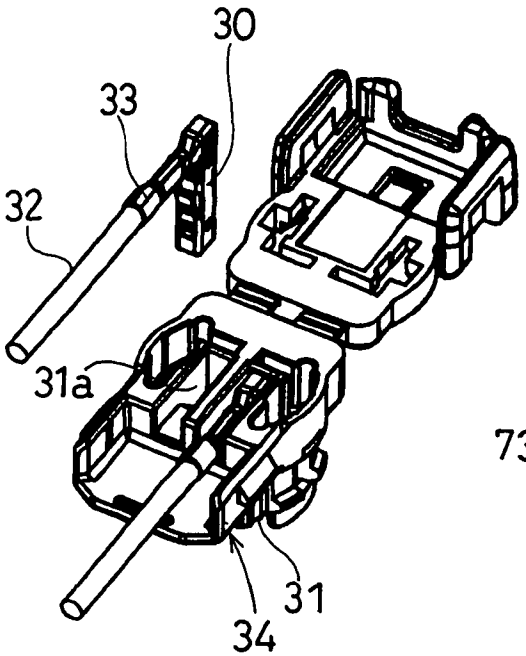
FIG. 1 is a process drawing showing a first half of a procedure of assembling a plug according to a first embodiment.
Figure 1:
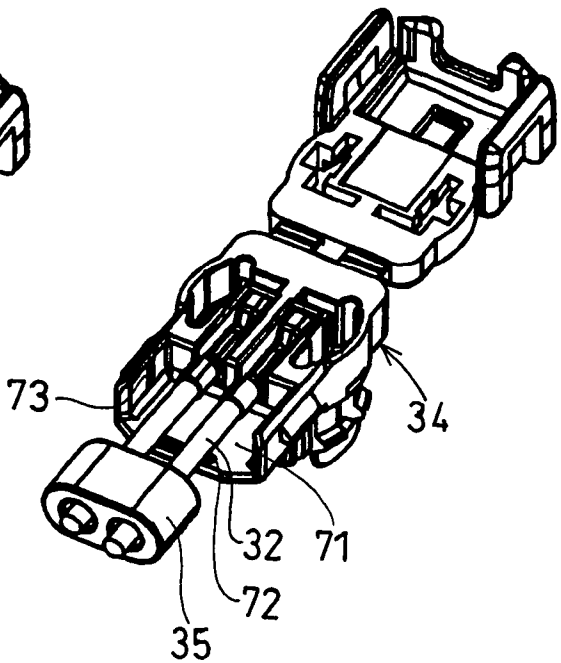
Figure 1:
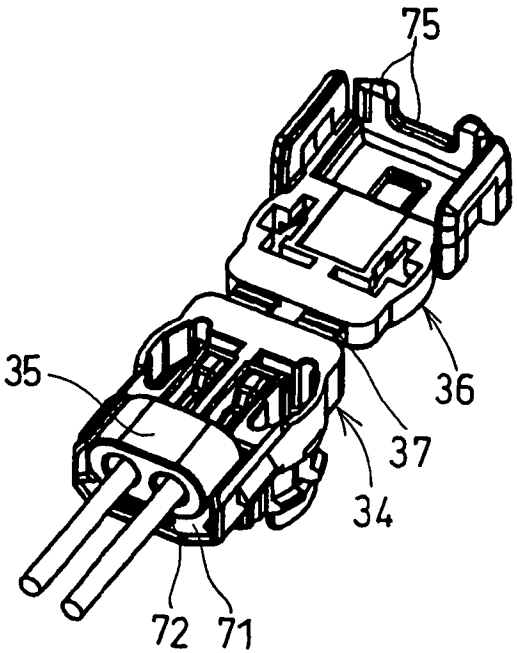
Figure 2:
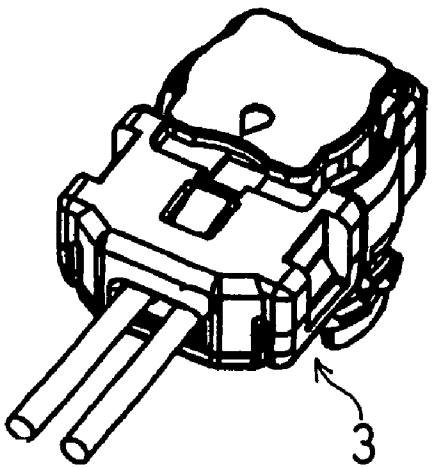
FIG. 2 is a process drawing showing a second half of the procedure of assembling the plug according to the first embodiment.
Figure 2:
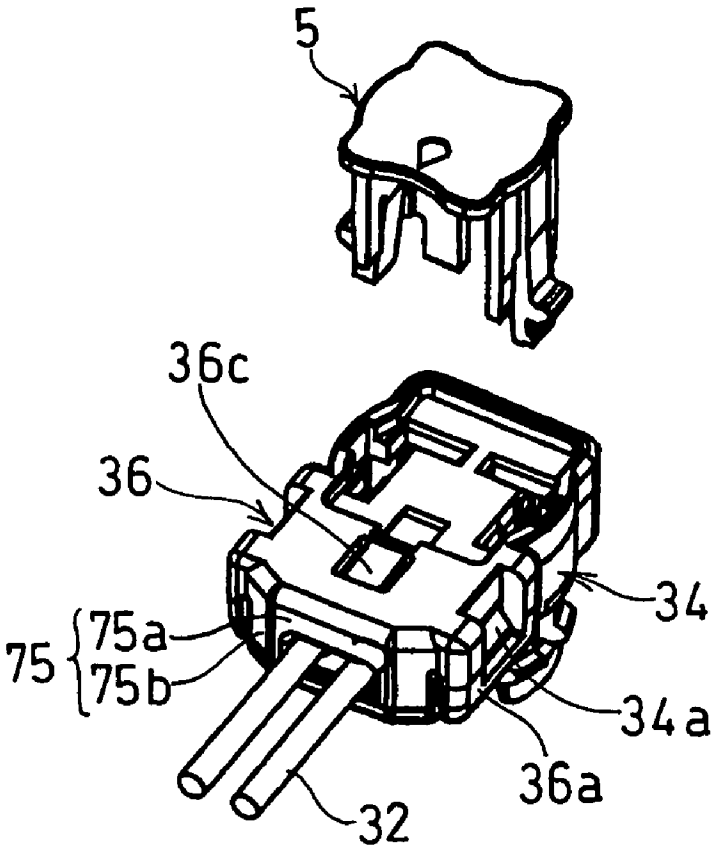
Figure 3:
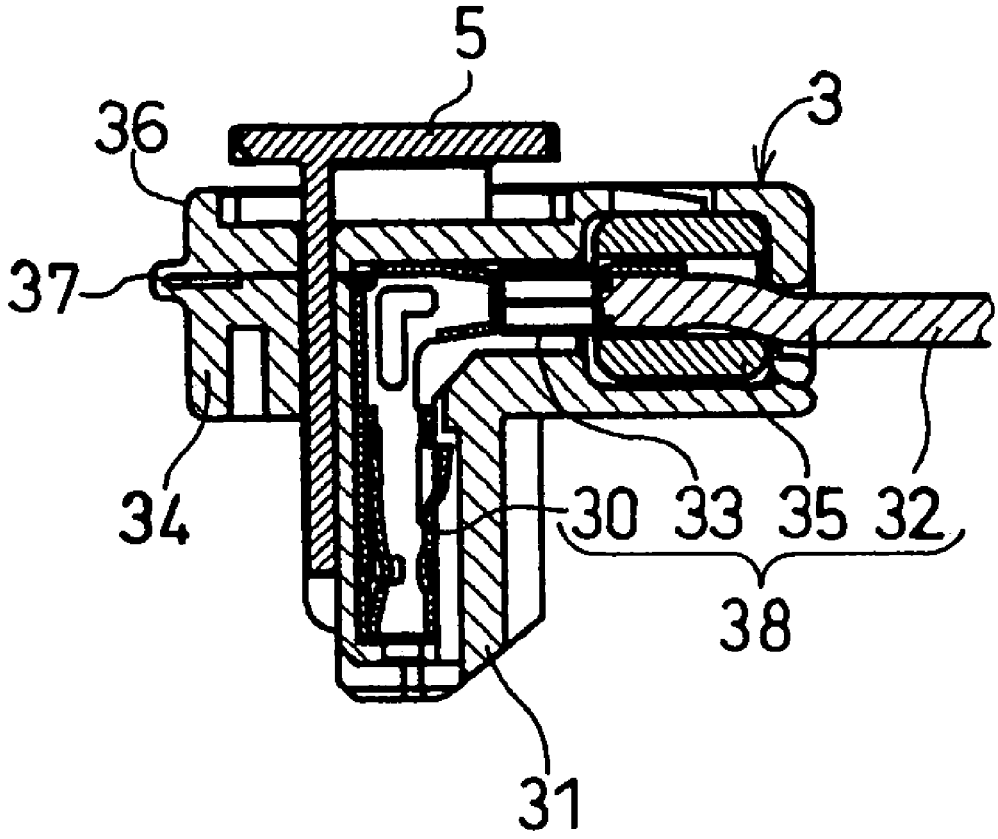
FIG. 3 is a cross sectional view showing a plug provided with a latch member.
Figure 6:
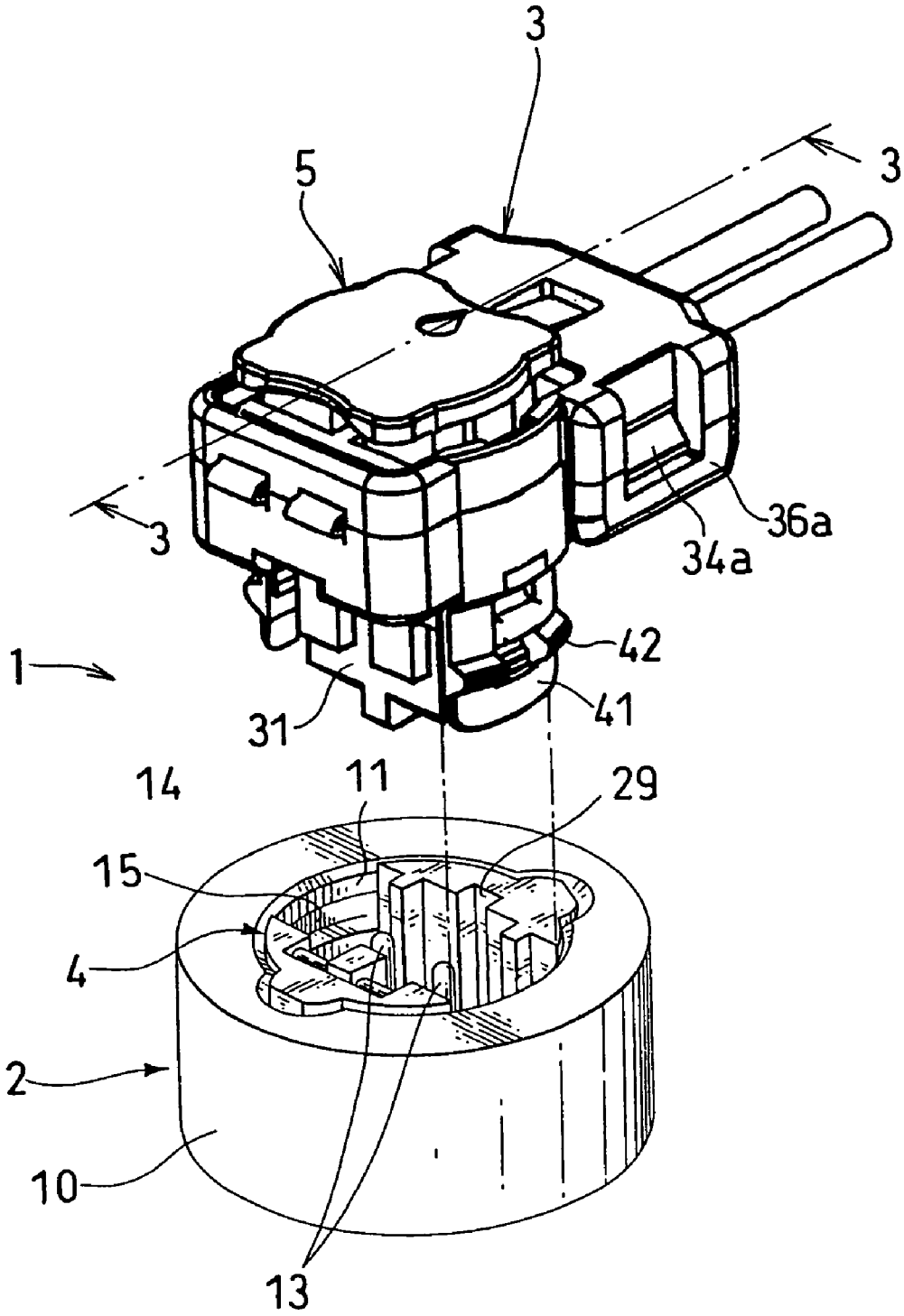
FIG. 6 is a perspective view showing a state before the plug according to the first embodiment is mounted on a socket.

Embodiments of the invention will be described below with reference to the drawings. FIG. 3 is a cross sectional view showing a plug for electric connectors, according to a first embodiment of the invention. FIGS. 1 and 2 are process drawings illustrating the assembling procedure of the plug. FIG. 6 is a perspective view showing an electric connector comprising a plug and a socket.

In FIG. 6, an electric connector 1 comprises a socket 2 that holds a short-circuit insert 4, and a plug 3 that holds a latch member 5. A cross section of the plug 3 shown in FIG. 6 is shown in FIG. 3. In FIG. 3, the plug 3 comprises an electric connection part 38 received in a housing 34 as a lower portion, and a cap 36 that serves as an upper portion to cover the housing 34. As apparent from the following descriptions, the plug 3 except electric wire and electric terminals is formed of an appropriate, non-conductive plastic material.

The electric connection part 38 comprises contacts 30 serving as a cylindrical-shaped terminal portion, lengths of electric wire 32 serving as conductors connected at connection parts 33 to the contacts 30, and a ferrite bead 35 serving as a noise filter inserted into electric wire 32.

The two contacts 30 constitute a pair of female-type electric terminals. Extensions extended from the cylindrical-shaped terminal portion that forms the female-type electric terminals are changed in direction to be substantially L-shaped. The connection parts 33 are provided at direction-changed ends to have one ends of the two lengths of electric wires 32 connected thereto. The lengths of electric wire 32 are insulation-sheathing ones. The insulation sheathing at one ends of the lengths of electric wires 32 is stripped off for electrical and mechanical mounting on the connection parts 33. The lengths of electric wire 32 are mounted to the contacts 30 by means of optional, conventional measures, ordinarily by crimping portions of the connection parts 33 around bare ends of the lengths of electric wire 32.

The pair of lengths of electric wire 32 connected to the contacts 30 go through the ferrite bead 35 received between the housing 34 and the cap 36, which are described later. As shown in FIG. 1, the lengths of electric wire 32 are cut to finite lengths so as to pass through the ferrite bead 35. The ferrite bead 35 is a columnar body having an elliptic-shaped cross section and having two parallel and cylindrical-shaped through-holes extending therethrough. The lengths of electric wire 32 are extended through the two through-holes. The ferrite bead 35 is formed of ferrite having a high magnetic permeability and acts in the same manner as a coil of an electric circuit. By cutting radio (noise) of high frequency in the same manner as a coil, malfunctioning of an airbag is prevented from occurring. The pair of lengths of electric wire 32 extending in parallel are taken out from rear ends of the housing 34 and the cap 36.

The housing 34 is shaped such that a plug portion 31 for latching of the pair of contacts 30 projects from a body. The cap 36 is latched in a state of covering the housing 34. Also, the housing 34 and the cap 36 are joined together to be able to fold at a tab portion 37.

Figure 4:
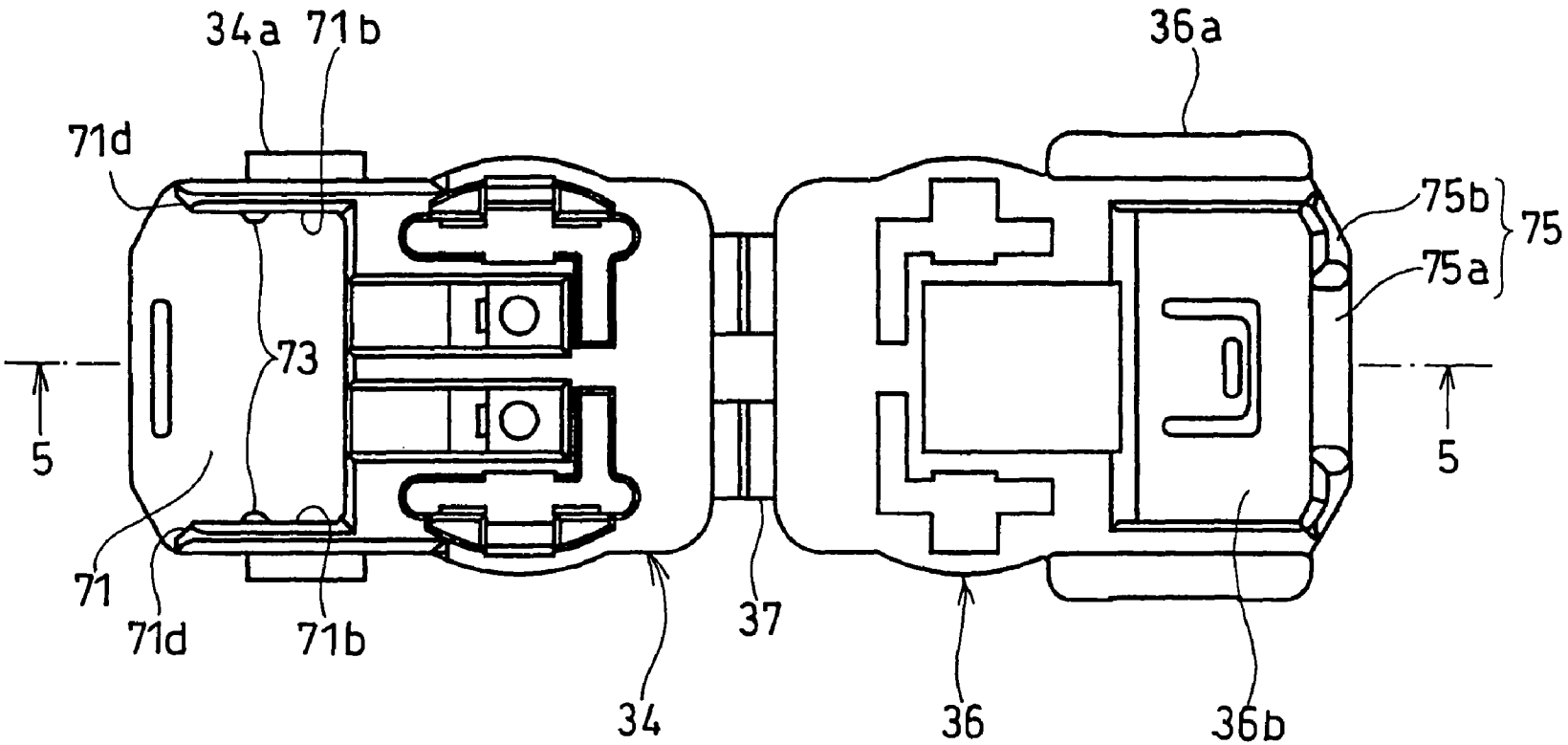
FIG. 4 is a plan view showing a housing and a cap in a developed state.
Figure 5:
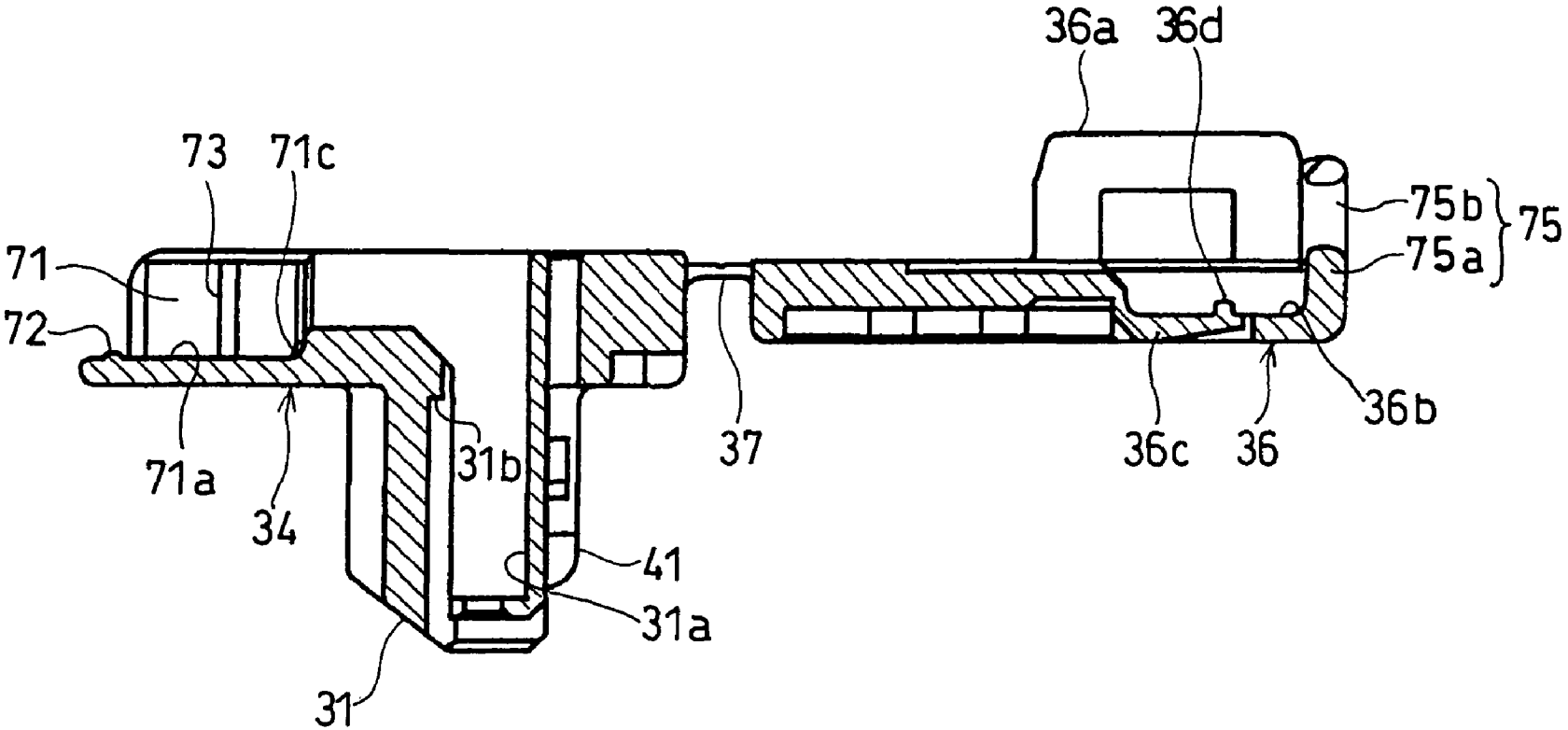
FIG. 5 is a cross sectional view taken along the line 5-5 in FIG. 4.

Details of the housing 34 and the cap 36 are shown in FIGS. 4 and 5. FIG. 4 is a plan view showing a state, in which the housing 34 and the cap 36 are developed, and FIG. 5 is a cross sectional view taken along the line 5-5 in FIG. 4.

In FIG. 5, the housing 34 has the plug portion 31 in the form of a rectangular cylinder projecting downward. A receiving section 31*a*, into which the contacts 30 are inserted, is formed in the plug portion 31. Also, provided in the receiving section 31*a* is a contact lock 31*b* for latching of the contacts 30. A pair of arcuate, elastic legs 41 are arranged outside both sides of the plug portion 31 (see FIG. 6). The elastic legs 41 are extended downward to support latch portions 42 expanding radially outward (see FIG. 6). The latch portions 42 are sized and arranged in a manner to be able to enter into latch grooves 15 when the plug 3 is appropriately engaged by the socket 2 (see FIG. 6).

As shown in FIGS. 4 and 5, the housing 34 is provided with an insertion space 71, into which the ferrite bead 35 can be inserted in a direction of extension of the electric wire 32. The insertion space 71 is defined by a bottom surface 71*a*, both sides 71*b*, and a tip-end abutting surface 71*c*. The insertion space 71 is opened at an upper surface thereof and on a side in the direction of extension of the electric wire 32.

Also, a rib 72 is provided integrally on the bottom surface 71*a* of the insertion space 71 to serve as coming-off preventive means for a rear end of the ferrite bead 35. The rib 72 preferably has a cross section that is inclined in a direction of insertion and has an abutting surface in a coming-off preventive direction. Also, the rib 72 preferably extends right and left on the bottom surface 71*a* along the rear end of the ferrite bead 35.

Also, the both sides 71*b*, 71*b* of the insertion portion are provided integrally with ribs 73, 73 that abut against sides of the ferrite bead 35. A spacing between the ribs 73, 73 is slightly smaller than a width of the ferrite bead 35. Therefore, the ribs 73, 73 abut against the sides of the ferrite bead 35, so that rattling of the ferrite bead 35 is suppressed.

Also, the both sides 71*b*, 71*b* of the insertion portion are formed at inlet sides thereof with inclined surfaces 71*d* that enlarges a frontage. Also, as shown in FIG. 1, front and rear ends of the ferrite bead 35 are reduced in diameter by means of chamfering or rounding. Therefore, at the time of insertion of the ferrite bead 35, the front surface on an insertion side is surely shaped to be reduced in diameter irrespective of forward and rearward directions.

The cap 36 is folded at the tab portion 37 to thereby cover the housing 34. Lock portions 36*a* are provided on both sides of the cap 36 to correspond to projections 34*a* of the housing 34 (see FIG. 6). The cap 36 comprises a wall surface 75 to correspond to the rear end of the ferrite bead 35. The wall surface 75 comprises a first low wall surface 75*a* that allows the lengths of electric wire 32 to extend outside and abuts against a portion of the rear end of the ferrite bead 35, and a second high wall surface 75*b* that abuts wholly against both sides of the rear end of the ferrite bead 35.

Also, provided on a bottom surface of the cap 36 in a recessed manner is a receiving section 36*b*, into which an upper portion of the ferrite bead 35 is fitted. A concave-shaped slit is cut into a portion of the receiving section 36*b* to provide an elastic piece 36*c*. A rib 36*d* is provided integrally on an upper side of the elastic piece 36*c*. The rib 36*d* abuts against the upper portion of the ferrite bead 35 to suppress rattling of the ferrite bead 35.

As shown in FIG. 3, when inserted into through-holes of the cap 36 and the housing 34, the latch member 5 is put in a first latched position to rise above the cap 36. When the plug 3 is mounted on the socket 2, the latch member 5 is put in a second latched position to descend to an upper surface of the cap 36. When put in the second latched position, the latch member 5 functions to prevent separation of the plug 3 from the socket 2 and to shift the short-circuit insert 4 of the socket 2 to a non-short-circuit position from a short-circuit position. In order to hold the latch member 5, the plug 3 and the electric connection part 38 are substantially L-shaped. And, because of being substantially L-shaped, a direction (up-and-down direction of the figure), in which the contacts 30 of the electric connection part 38 are positioned relative to the housing 34, and a direction (right-and-left direction of the figure), in which the ferrite bead 35 of the electric connection part 38 is positioned relative to the housing 34, are made different from each other.

The procedure of assembling the plug 3 having such construction will be described with reference to FIGS. 1 and 2. FIG. 1 illustrates the procedure of assembling a current-carrying portion to the housing 34 and FIG. 2 illustrates the procedure of covering the housing 34 with the cap 36 to assemble them.

First, the contacts 30 and the lengths of electric wire 32 having ends are joined at the connection portion 33 as shown in FIG. 1(*a*). The parts in the joined state are inserted into the receiving section 31*a* within the plug portion 31 of the housing 34. The receiving section 31*a* is in the form of a substantially L-shaped recess and the contacts 30 are positioned by the receiving section 31*a*. Thereby, the lengths of electric wire 32 are directed in parallel within the housing 34. Also, elastic pieces of the contacts 30 engage with the contact lock 31*b* in the receiving section 31*a* whereby the contacts 30 are latched in the housing 34 (see FIG. 5).

Next, ends of the pair of lengths of electric wire 32 aligned in parallel are passed through the two through-holes of the ferrite bead 35 as shown in FIG. 1(*b*). Then, the ferrite bead 35 is pushed toward the insertion space 71 of the housing 34. The ferrite bead 35 is easily guided into the insertion space 71 owing to chamfering of the end of the ferrite bead 35 and the inclined surfaces at the inlet of the insertion space 71. The ferrite bead 35 gets over the coming-off preventive rib 72 provided on the bottom surface of the insertion space 71 and is inserted further. When the ferrite bead 35 is inserted to some extent, sides of the ferrite bead 35 are interposed by the ribs 73 provided on the sides of the insertion space 71.

When the ferrite bead 35 abuts against a tip end of the insertion space 71 in the housing 34 as shown in FIG. 1(*c*), the ferrite bead 35 gets over the rib 72 on the bottom surface of the insertion space 71. Then, the rib 72 functions to prevent the ferrite bead 35 from coming off the insertion space 71. Also, the ribs 73 provided on the side of the insertion space 71 abut against the both sides of the ferrite bead 35 in a manner to interpose the same therebetween. As a result, the ferrite bead 35 does not rattle within the insertion space 71.

Next, the cap 36 connected via the tab 37 to the housing 34 is swung toward the housing. The both members are latched on each other when the cap 36 is put in a state to cover the housing 34. As shown in FIG. 2(*d*), the projections 34*a* of the housing 34 are latched on the lock portions 36*a* of the cap 36. In the latched state, the wall surface 75 of the cap 36 covers the rear end of the ferrite bead 35 while leaving a space, through which the pair of lengths of electric wire 32 having through the ferrite bead 35 pass. Therefore, the ferrite bead 35 is fixed in the housing 34 so as not to come off. Also, the inner rib 36*d* of the elastic piece 36*c* on the cap 36 pushes an upper surface of the ferrite bead 35. Therefore, the ferrite bead 35 will not rattle further within the insertion space 71. Then, the latch member 5 is passed through passing-through portions, which are provided on the housing 34 and the cap 36 and in which L-shapes face each other. Then, assembling is completed as shown in FIG. 2(*e*) to provide a plug 3.

As described above, the plug is constructed such that the housing 34 comprises the insertion space 71 that affords fitting the lengths of electric wire 32 onto the ferrite bead 35 before the housing is covered by the cap 36 after the contacts 30 are latched, and the cap 36 comprises the wall surface 75 provided in a direction, in which the ferrite bead 35 comes off, and the plug is assembled in the procedure including (1) a step of latching the contacts 30 on the plug portion 31 of the housing 34, (2) a step of fitting the noise filter 35 onto the lengths of electric wire 32 that are connected to the contacts 30 and disposed within the housing 34, and (3) a step of covering the housing 34 with the cap 36 and forming the wall surface 75 in a direction, in which the noise filter 35 comes off.

Therefore, the connection part 38 can be placed in a predetermined position within the housing 34 only by an operation, in which the contacts 30 are latched on the housing 34, and the noise filter 35 is fitted onto the lengths of electric wire 32 and pushed into the insertion space 71 of the housing 34. Therefore, it is possible to assemble the plug in a simple and sure manner. The plug portion 31 is provided on the housing 34 in a manner to be made perpendicular thereto and is generally substantially L-shaped. Therefore, a direction, in which the contacts 30 are positioned, and a direction, in which the noise filter 35 is positioned, are perpendicular to each other. However, according to the procedure of assembling, the noise filter 35 can be positioned by fitting the noise filter 35 onto the lengths of electric wire 32 after the contacts 30 are positioned. Therefore, the both operations of positioning will not interfere with each other. In particular, with an squib electric connector used in airbag systems for automobiles, the above assembling of a plug is performed when an airbag system is finished, so that a plug is advantageous to be constructed to afford simply and surely positioning of the contacts 30 and the noise filter 35.

Also, the rib 72 as coming-off preventive means for the noise filter 35 is provided in the insertion space 71 of the housing 34. Therefore, the noise filter 35 once having been pushed into the insertion space 71 will not come off. Therefore, a disadvantage will not be caused, in which when the cap 36 subsequently covers the housing, the noise filter 35 comes off to abut thereagainst.

Also, a front surface of the noise filter 35 on an insertion side is shaped to be reduced in diameter by chamfering. Therefore, when the noise filter 35 is inserted into the insertion space 71 of the housing 34, it becomes easy to push the noise filter 35.

Also, the ribs 73 are provided in the insertion space 71 of the housing 34 to abut against the sides of the noise filter 35. Therefore, the noise filter 35 will not rattle within the insertion space 71 of the housing 34. Therefore, the plug is suited to a squib electric connector for automobiles, of which it is demanded to restrict generation of abnormal noise due to vibrations as much as possible.

The embodiment described above can be modified and carried out in the following manner. (a) The embodiment is not limited to an arrangement, in which the contacts 30 and the lengths of electric wire 32 are connected to each other in a L-shaped configuration. For example, even a plug, in which the contacts 30 and the lengths of electric wire 32 are linearly connected to each other, is applicable to the case where the noise filter 35 in a state of being fitted onto the lengths of electric wire 32 is received in the housing 34. Also, even a plug, in which the latch member 5 is not used, is applicable to the case where the noise filter 35 in a state of being fitted onto the lengths of electric wire 32 is received in the housing 34. (b) The contacts 30 are not limited to a cylindrical-shaped female type but may be, for example, a pin-shaped male type. Also, the noise filter 35 is not limited to a ferrite bead but may be made of a material, other than ferrite, having a high magnetic permeability. Also, it suffices that the noise filter 35 act in the same manner as a coil of an electric circuit to cut radio of high frequency.

Figure 7:
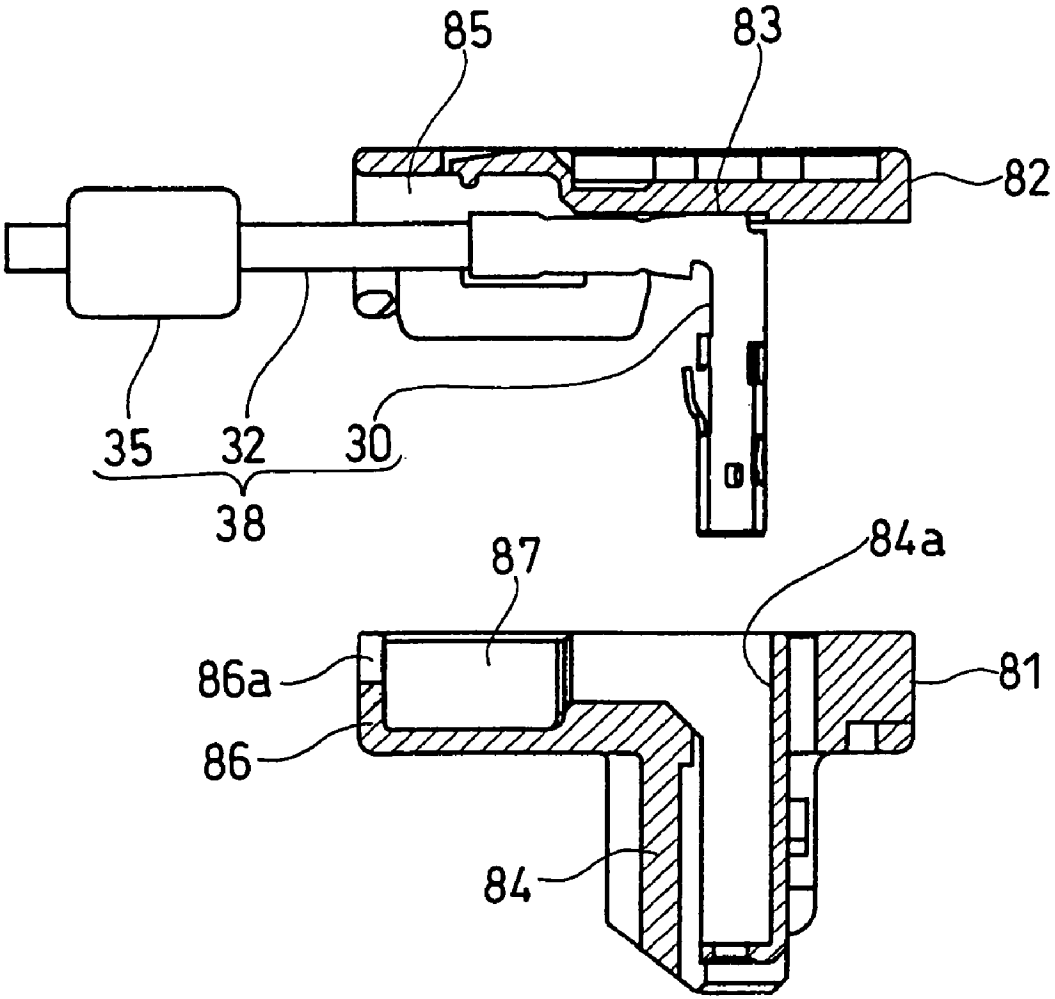
FIG. 7 is a cross sectional view showing a state before a plug according to a second embodiment is assembled.

Next, a second embodiment of the invention will be described with reference to FIG. 7. The embodiment is different from the first embodiment in that the electric connection part 38 is first latched not on a housing 81 but on a cap 82. Also, the housing 81 and the cap 82 are not connected to each other by means of a tag but are formed to be independent of each other. The embodiment is the same as the first embodiment in a construction except the different portions.

The cap 82 is provided with a temporary latch portion 83 that temporarily fixes the contacts 30 in predetermined positions. The temporary latch portion 83 is formed from, for example, a push latch portion. The two contacts 30 in a parallel state are temporarily latched in predetermined positions on the cap 82. The contacts 30 in the temporary latched positions are temporarily latched on the cap 82 in a manner to correspond to a receiving section 84*a* of a plug portion 84 of the housing 81.

Also, the cap 82 is provided with an insertion space 85 that allows fitting of the ferrite bead 35, which is to be fitted onto the lengths of electric wire 32, in a direction along the lengths of electric wire 32. It is desired that either or both of a rib for prevention of coming-off of the ferrite bead 35 after the fitting, and ribs for elimination of rattling of the ferrite bead 35 after the fitting be provided inside the insertion space 85.

Also, the housing 81 comprises a wall surface 86, to which a rear end of the ferrite bead 35 being inserted into the insertion space 85 is opposed. The wall surface 86 is provided as a rear wall of a receiving section 87 for the ferrite bead 35, and comprises a minimum space 86*a*, through which the lengths of electric wire 32 can be taken out.

The procedure of assembling the plug 3 according to the second embodiment will be described. First, two contacts 30, to which the lengths of electric wire 32 are connected, are temporarily latched on the cap 82. Next, the ferrite bead 35 is fitted onto the two lengths of electric wire 32 and pushed up to an end of the insertion space 85 of the cap 82.

Next, the cap 82, to which the electric connection part 38 including the ferrite bead 35 is fixed, is pushed toward the housing 81. The contacts 30 are received in and latched on the receiving section 84*a*, and simultaneously therewith the ferrite bead 35 enters the receiving section 87, whereby the wall surface 86 blocks in a direction, in which the ferrite bead 35 comes off.

As described above, the plug is constructed such that the cap 82 comprises the temporary latch portion 83 for the contacts 30 and the insertion space 85 that allows fitting of the noise filter 35 onto the lengths of electric wire 32 before the cap covers the housing 81, and the housing 81 comprises the wall surface 86 opposed to the noise filter 35 in a coming-off direction when the contacts 30 are latched on the plug portion 84, and the plug is assembled in the procedure including (1) a step of temporarily latching the contacts 30 on the cap 82, (2) a step of fitting the noise filter 35 onto the lengths of electric wire 32 that are connected to the contacts 30 and disposed on the cap 82, and (3) a step of covering the housing 81 with the cap 82, to which the electric connection part 38 is fixed, latching the contacts 30 on the plug portion 84 of the housing 81, and forming the wall surface 86 opposed to the noise filter 35 in the coming-off preventive direction.

Therefore, the connection part 38 can be placed in a predetermined position within the cap 82 only by an operation, in which the contacts 30 are temporarily latched on the cap 82, and the noise filter 35 is fitted onto the lengths of electric wire 32 and pushed into the insertion space 85 of the cap 82. As a result, it is possible to assemble the plug in a simple and sure manner.

Further, a construction of an squib electric connector 1, to which the plugs according to the first and second embodiments are applied, will be described.

Figure 8:
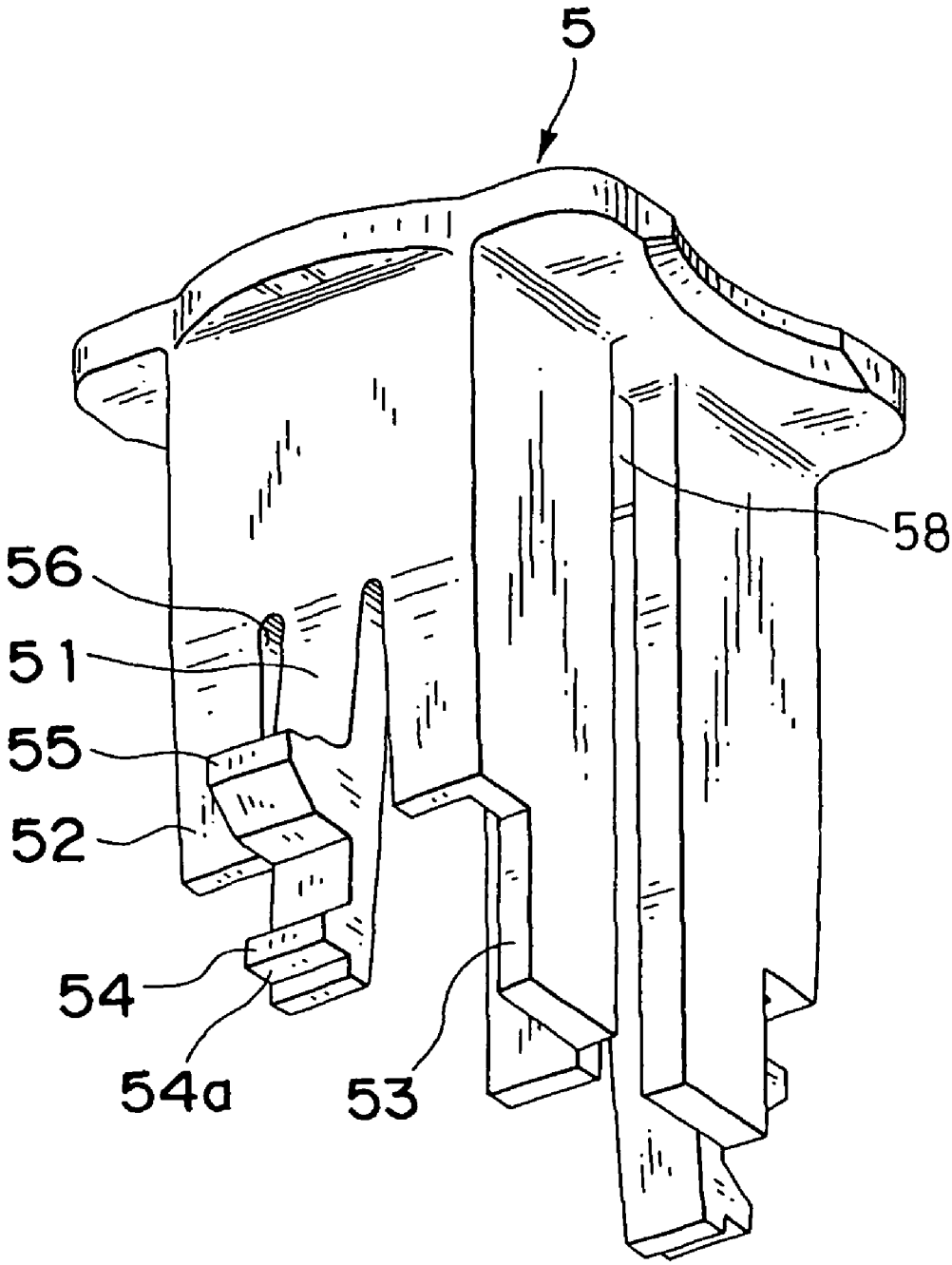
FIG. 8 is a perspective view showing a latch member applied to a plug.

The latch member 5 for the socket 2 is used for the plug 3 described above. The latch member 5 is latched on the plug 3 in a first position. When the plug 3 is mounted on the socket 2, the latch member 5 is movable from the first position to a second position. When the latch member 5 comes to the second position, the latch member 5 functions to shift the short-circuit insert 5 of the socket 3 to a non-short-circuit position from a short-circuit position and to prevent separation of the plug 3 from the socket 2. As shown in FIG. 8, the latch member 5 comprises a roof portion or a push portion 50, a pair of first legs 51 extending downward from both widthwise sides of the push portion 50, regulating portions 52 positioned on both sides of the first legs 51, and a pair of second legs 53 extending downward in a row from lengthwise ends of the push portion 50. Also, the first legs 51 comprise a first latch 54 and a second latch 55 in the order from under. The first latch 54 is shaped to project outside over a small extent. The second latch 55 is shaped to project outside over a large extent. The first latch or the small projection 54 of the first legs 51 is formed at a tip end thereof with a step 54*a*.

Figure 10:
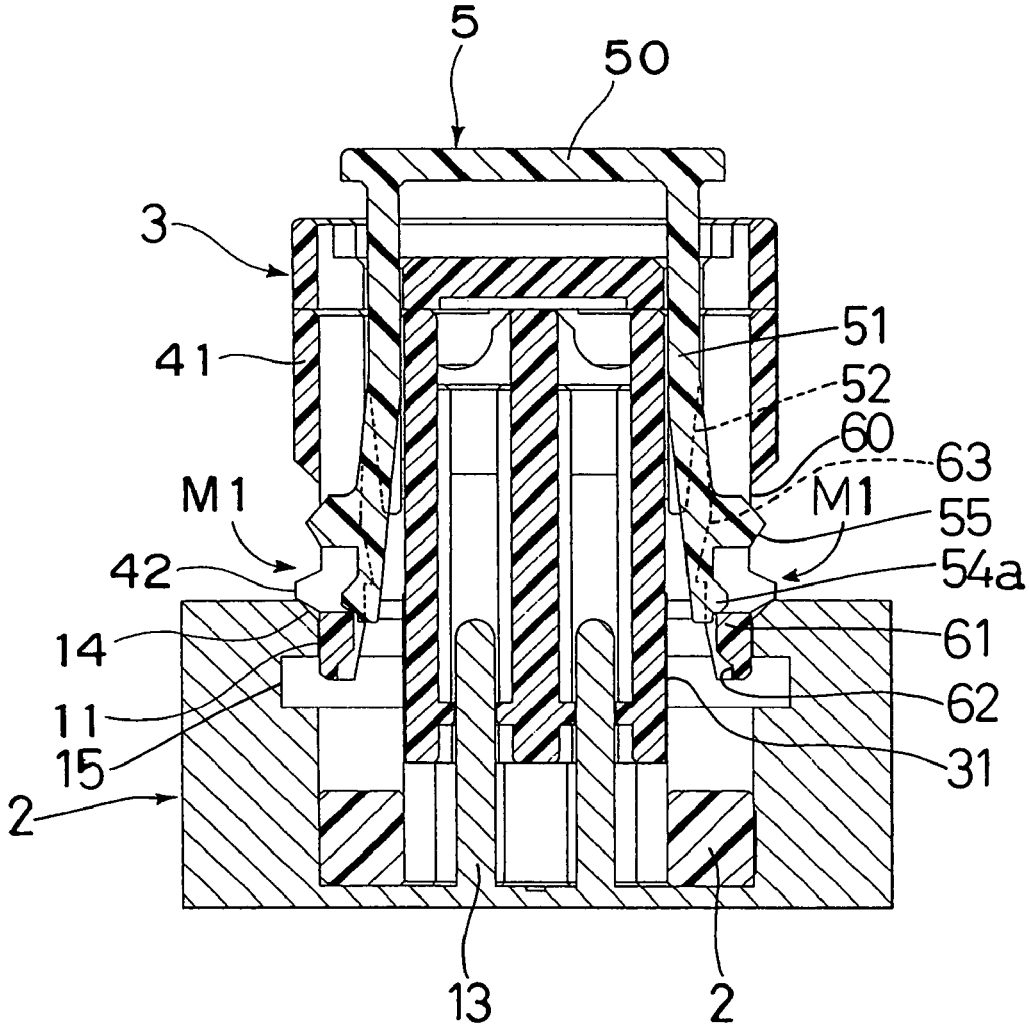
FIG. 10 is a cross sectional view showing a state before the plug according to the first embodiment and the second embodiment with the use of a latch member is mounted on the socket.

As shown in FIG. 10, steps 61 are formed at lower ends of openings 60 in the elastic legs 41 of the plug 3. In a state of being inserted into the plug 3, the latch member 5 is put in a state of being latched in the first latched position since the steps 54*a* of the first legs 51 abut against the steps 61 of the elastic legs 41. At this time, the second latches or the large projections 55 of the latch member 5 project outside from the openings 60 to be put in a state to be able to act. Latch grooves 62 scraped radially inward are formed inside the lower ends of the elastic legs 41. The outer projections of the first latches 54 of the latch member 5 having been moved from the first latched position are latched on the latch grooves 62 whereby the latch member 5 is put in the second latched position. Latching in the second latched position is effected to such a degree that the latch member 5 can be returned to the first latched position by lifting the latch member 5 from the plug 3.

As shown in FIG. 8, the regulating portions 52 on both sides of the first leg 51 are disposed with slits 56 therebetween not to hinder elastic deformation of the first leg 51 and formed in a manner to be decreased in thickness as they go downward. As indicated by dotted portions in FIG. 10, the regulating portions 52 are positioned between an inside of thick wall portions 63 in the elastic legs 41 of the plug 3 and an outside of the plug portion 31. In a state, in which the latch member 5 is in the first latched position, that is, the roof portion 50 is separated from the plug 3 as shown in the figure, inward deformation of the latch portions 42 of the elastic legs 41 are not regulated by the regulating portions 52. As best shown by dotted lines in FIG. 11, when the latch member 5 is moved to the second latched position, that is, a position, in which the roof portion 50 is received in a recess 45, the regulating portions 52 descend to a position to be opposed to inner extensions 63*a* of the thick wall portions 63. Thereby, when the latch portions 42 are going to disengage from the latch grooves 15, the inner extensions 63*a* abut against the regulating portions 52, so that the latch portions 42 will not disengage. In a normal state, however, there are clearances between the regulating portions 52 and the plug portion 31 and the thick wall portions 63 of the elastic legs 41. Therefore, the latch member 5 ensures smooth movements of insertion from the first latched position to the second latched position.

As shown in FIG. 8, the second legs 53 are in the form of plates that extend lowermost. The latch member 5 is pushed into the second latched position from the first latched position. Then, the latch member 5 advances up to bent portions of short-circuit clips 24 to retreat abutments 27 from the pins 13 and to act to release electric short-circuiting of the pins 13 (see FIG. 9). The short-circuit insert 4 puts contacts of the socket 2 in a short-circuit state until the plug 3 mechanically and electrically engages with the socket 2.

Figure 9:
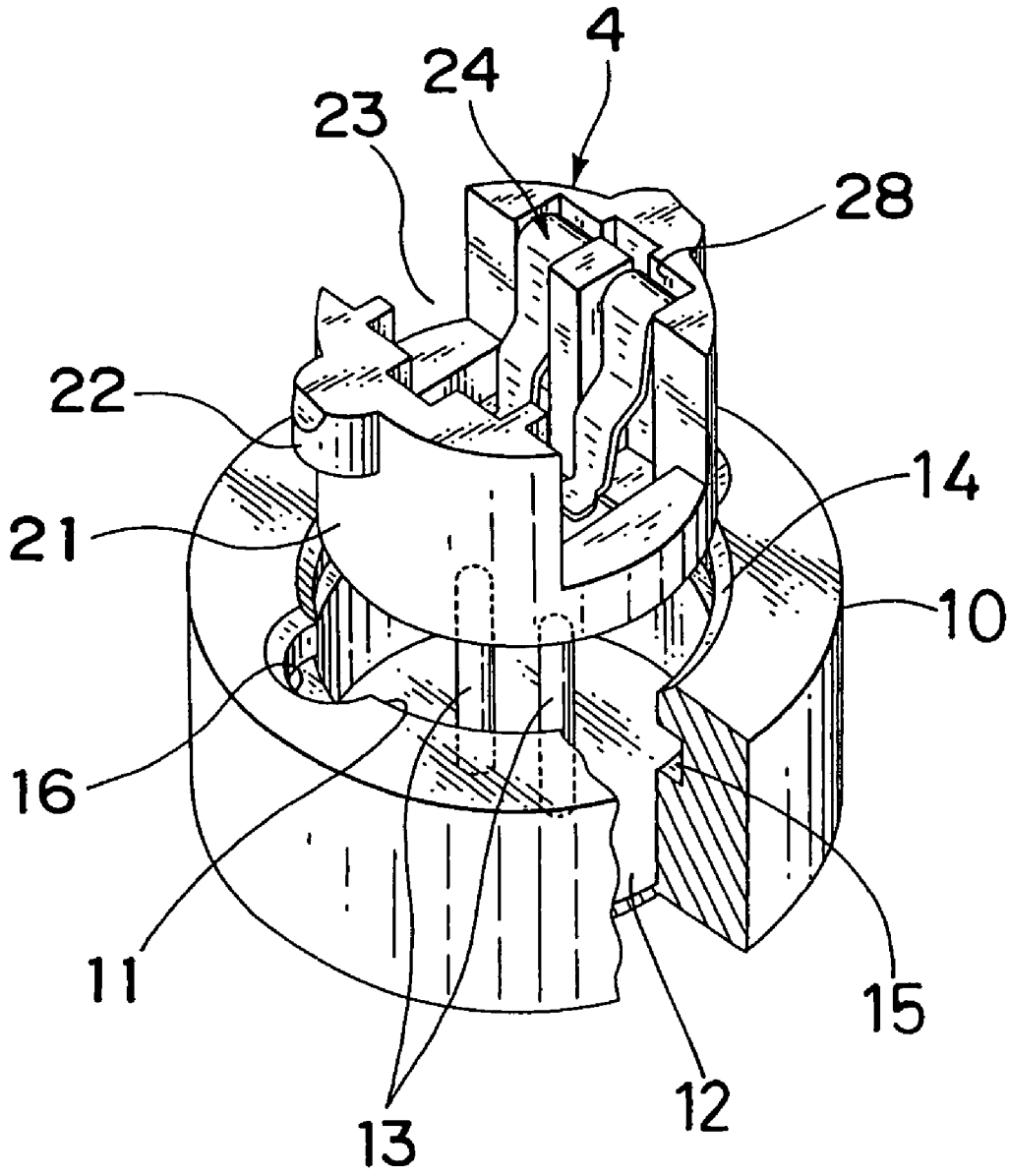
FIG. 9 is a perspective view showing a socket and its short-circuit insert for the plug according to the first embodiment and the second embodiment.

The socket 2 is shown in FIGS. 6 and 9 as being provided with a cylindrical-shaped body 10 that forms an opening 11. The body 10 formed with the opening 11 can be built directly in an associated structure such as a housing of an ignition device, etc. Further, the opening 11 can be formed as a separate element to be added to an associated structure. In both cases, the body 10 formed with the opening 11 terminates at a bottom wall 12 and the pins 13 being a pair of male type connectors made of metal and having electric conductivity are extended from the bottom wall 12. Such two pins 13 are connected to respective conductors of an airbag ignition device (not shown) in an optional, conventional method, whereby electric energy is given to the ignition device via the pins 13.

An inclined surface 14 is formed at an inlet of the opening 11 and a circumferentially continuous latch groove 15 is formed inside of the opening 11. As best shown in FIG. 10, the inclined surface 14 bears the latch portions 42 of the elastic legs 41 of the plug 3. The inclined surface 14 serves to bear the second latches 55 of the latch member 5 to generate a centrally directed deformation moment. The latch groove 15 receives therein the latch portions 42 of the plug 3. The latch groove 15 serves to maintain an engaged state and to receive therein the second latches 55 of the latch member 5 to effect switching to the second latched position.

As shown in FIG. 9, a semi-circular recess 16 is provided in one position at the inlet of the opening 11. The recess 16 serves to set an orientation of the short-circuit insert 4 when the short-circuit insert 4 is arranged in the socket 11. The short-circuit insert 4 is received in the opening 11. When the plug 3 engages with the socket 2 and the latch member 5 of the plug 3 does not come to the second latched position, the short-circuit insert 4 can realize a state of electric connection therebetween to thereby serve to cause short-circuiting of the male type contacts 13.

As shown in FIG. 9, the short-circuit insert 4 comprises a columnar-shaped body 21 that is molded from plastic and sized to be tightly received in the opening 11. Provided on a side of an upper surface of the body 21 are semi-cylindrical projections 22 that are short and extended downward to be disposed and sized to be able to be received in the recesses 16. The projections 22 serve to appropriately orient the short-circuit insert 4 relative to the opening 11. Further, the body 21 comprises an opening 23, through which the pins 13 being male type connectors extend and which is disposed centrally to be opened to an upper surface and both sides.

The short-circuit clips 24 are held in the body 21 of the short-circuit insert 4. The short-circuit clips 24 are formed of an elastic, conductive material such as spring steel. Portions of the short-circuit clips 24 are deflected in a direction to abut against the both pins 13 to form an electric short-circuit therebetween.

A connecting operation of the electric connector 1 comprising the socket 2 and the plug 3 described above will be described with reference to FIGS. 10 and 11. As shown in FIG. 10, the short-circuit insert 4 is beforehand fitted into the opening 11 of the socket 2 to thereby form electric short-circuit for the pins 13. The latch member 5 is beforehand latched on the plug 3 in the first position, that is, in a state, in which the first latch 54 abuts against the steps 61. Even when the latch member 5 is pushed against the plug 3 in a state, in which the plug 3 is separated from the socket 2, the latch member 5 does not descend. Therefore, the roof portion 50 of the latch member 5 remains above the recess 45 of the plug 3, which state can be visually confirmed.

FIG. 10 clearly shows a state, in which a side of the plug 3 is held by a hand to insert parallel portions at the lower ends of the elastic legs 41 into the opening 11 of the socket 2. The latch portions 42 of the elastic legs 41 abut against the inclined surface 14 at the inlet of the opening 11 to stop there. When the roof portion 50 of the latch member 5 is pushed by, for example, a thumb from the above state, an inwardly directed moment M1 acts on the elastic legs 41. Then, the elastic legs 41 and the first legs 51 are bent inward and the latch portions 42 of the elastic legs 41 are fitted into the latch groove 15. At this time, the regulating portions 52 of the latch member 5 are positioned upward and do not regulate deformation of the elastic legs 41.

When the latch portions 42 of the elastic legs 41 are fitted into the latch groove 15, the second latches 55 of the latch member 5 interfere with the inclined surface 14 at the inlet of the opening 11 at that point of time. In this state, an inwardly directed moment M2 acts on the first legs 51 and the first latches 54 of the first legs 51 have already separated from the steps 61 of the elastic legs 41. Therefore, an action that pushes the roof portion 50 of the latch member 5 continues, so that the latch member 5 further descends.

Figure 11:
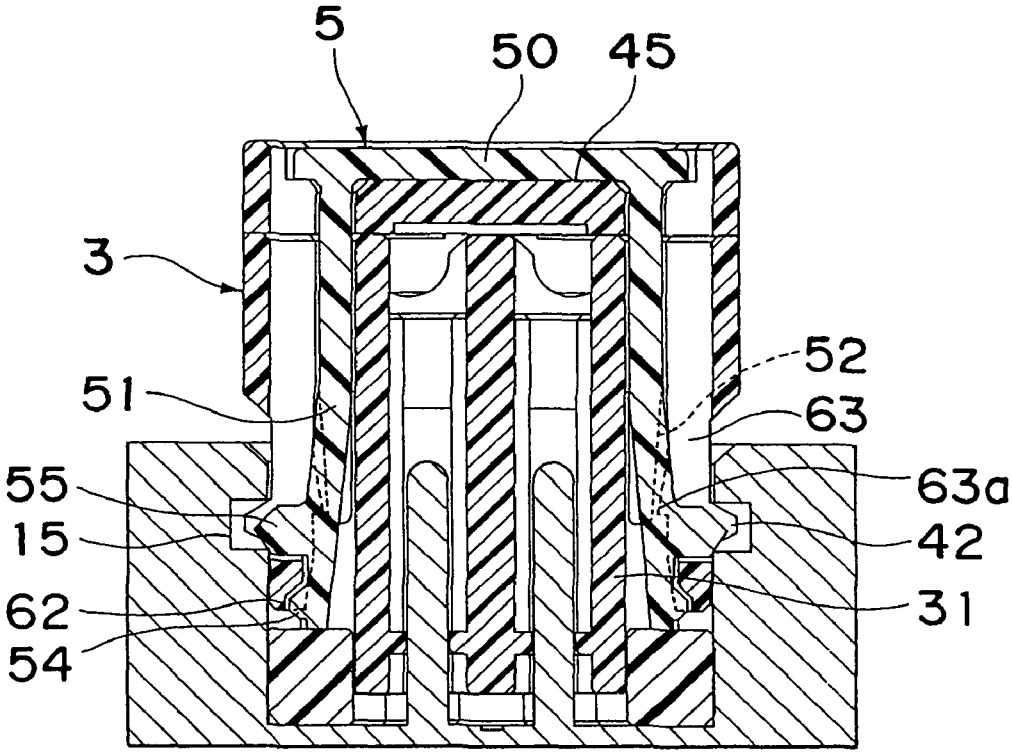
FIG. 11 is a cross sectional view showing a state after the plug according to the first embodiment and the second embodiment with the use of a latch member is mounted on the socket.

As shown in FIG. 11, there is caused the second latched position, in which the second latches 55 of the first legs 51 are received in the latch groove 15 and the first latches 54 of the first legs 51 are latched in the latch grooves 62. Also, the regulating portions 52 of the latch member 5 descend to a position to be opposed to the inner extensions 63*a* of the thick wall portion 63 (near an area, in which the latch groove 15 and the latch portions 42 engage with each other). As a result, a motion, in which the latch portions 42 are going to disengage from the latch groove 15, is regulated and so the plug 3 will not disengage from the socket 2. In the second latched position, the roof portion 50 of the latch member 5 gets into the recess 45 of the plug 3. Thereby, it can be visually confirmed that the mechanical engagement of the socket 2 and the plug 3 has been completely terminated. Also, tip ends of the second legs 53 of the latch member 5 extend stepped bent portions midway the short-circuit clips 24. As a result, the short-circuit clips 24 separate from sides of the pins 13, so that the pins 13 are released from a short-circuit state and electric fitting is completely terminated.

In this manner, mechanical and electrical engagement of the plug 3 with the socket 2 is completely terminated by a single action of pushing the latch member 5. When the mechanical engagement of the plug 3 with the socket 2 is completed, the plug 3 cannot be removed from the socket 2 unless the latch member 5 is returned to the first latched position from the second latched position.

Figure 12:
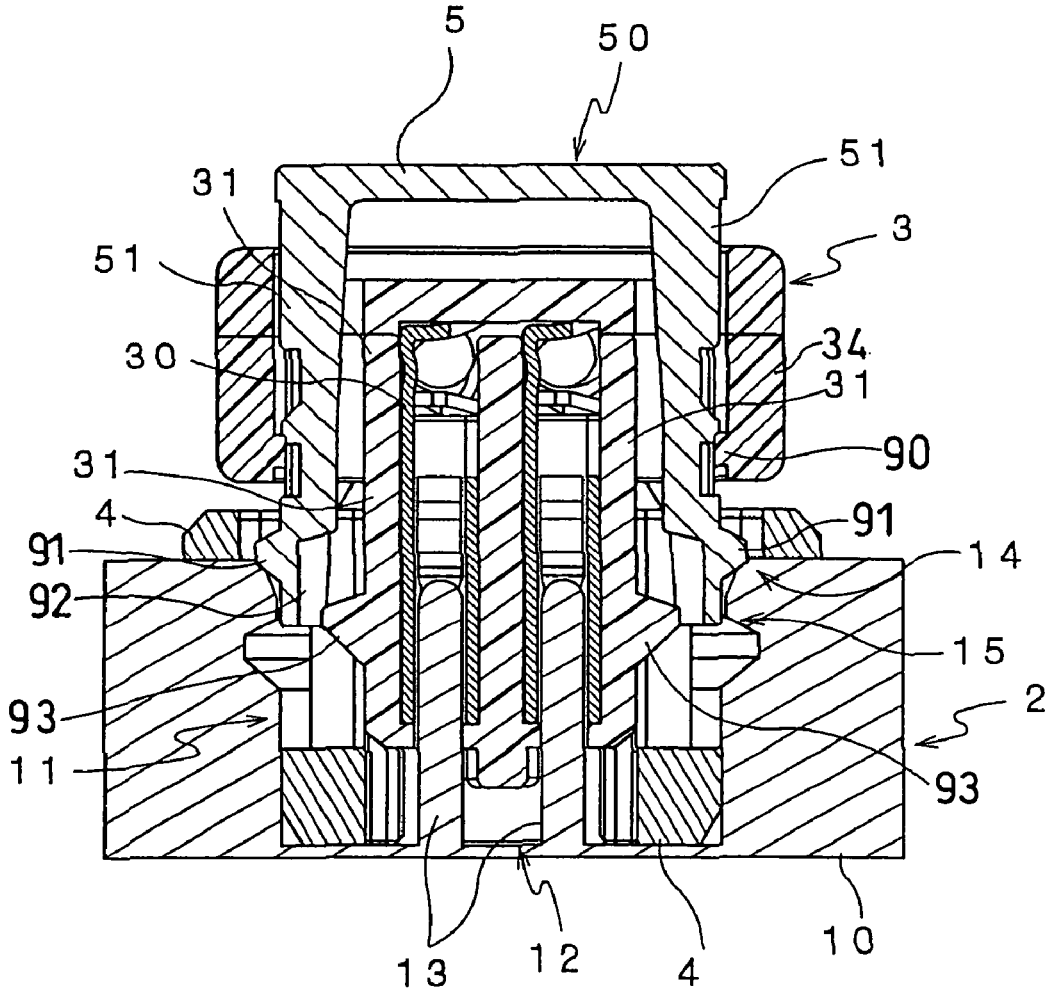
FIG. 12 is a cross sectional view showing a state before the plug according to the first embodiment and the second embodiment with the use of a further latch member is mounted on the socket.

FIG. 12 is a view showing a further embodiment of a latch member 5. With the latch member 5, the plug 3 is mounted on the socket 2. Then, the short-circuit insert 4 is retreated to a non-short-circuit position and made movable so as to engage with the socket 2. Further, when the latch member 5 engages with the socket 2, separation of the socket 2 and the plug 3 from each other is prevented.

An intermediate portion of the latch member 5 is latched on a latch projection 90 of a housing 34 to be held in a first latched position. Latch portions 91 for the latch groove 15 are provided in an expanded manner on a lower portion of the latch member 5. Recesses 92 are formed at the back of the latch portions 91. The recesses 92 are provided in positions to be able to latch on projections 93 provided on the plug portion 31, which is positioned to be interposed between the opposed first legs 51, when the latch portions 91 are put in a state to engage with the latch groove 15.

As shown in FIG. 12, when a push portion 50 of the latch member 5 is pushed while the plug 3 bears against the socket 2, the latch portions 91 of the latch member 5 abuts against the inclined surface 14 to be reduced in diameter. Then, the latch member disengages from the latch projection 90 to advance toward the socket 2. When the latch portions 91 of the latch member 5 are fitted into the latch groove 15, mounting of the plug 3 on the socket 2 is completed. Simultaneously with such mounting, the short-circuit insert 4 is retreated to a non-short-circuit position in the same manner as the latch member 5 in FIG. 10. Also, when the housing 34 of the plug 3 is lifted as by pulling up the lengths of electric wire, the projections 93 abut against the recesses 92. Then, reduction of the latch portions 91 in diameter is restricted and separation of the plug 3 from the socket 2 is prevented.

In case of using either of the latch members shown in FIG. 10 or FIG. 12, the plug 3 is mounted on the socket 2. In a state, in which the latch member 5 falls, the short-circuit insert 4 is retreated to the non-short-circuit position and separation of the plug 3 from the socket 2 is prevented.

Figure 13:
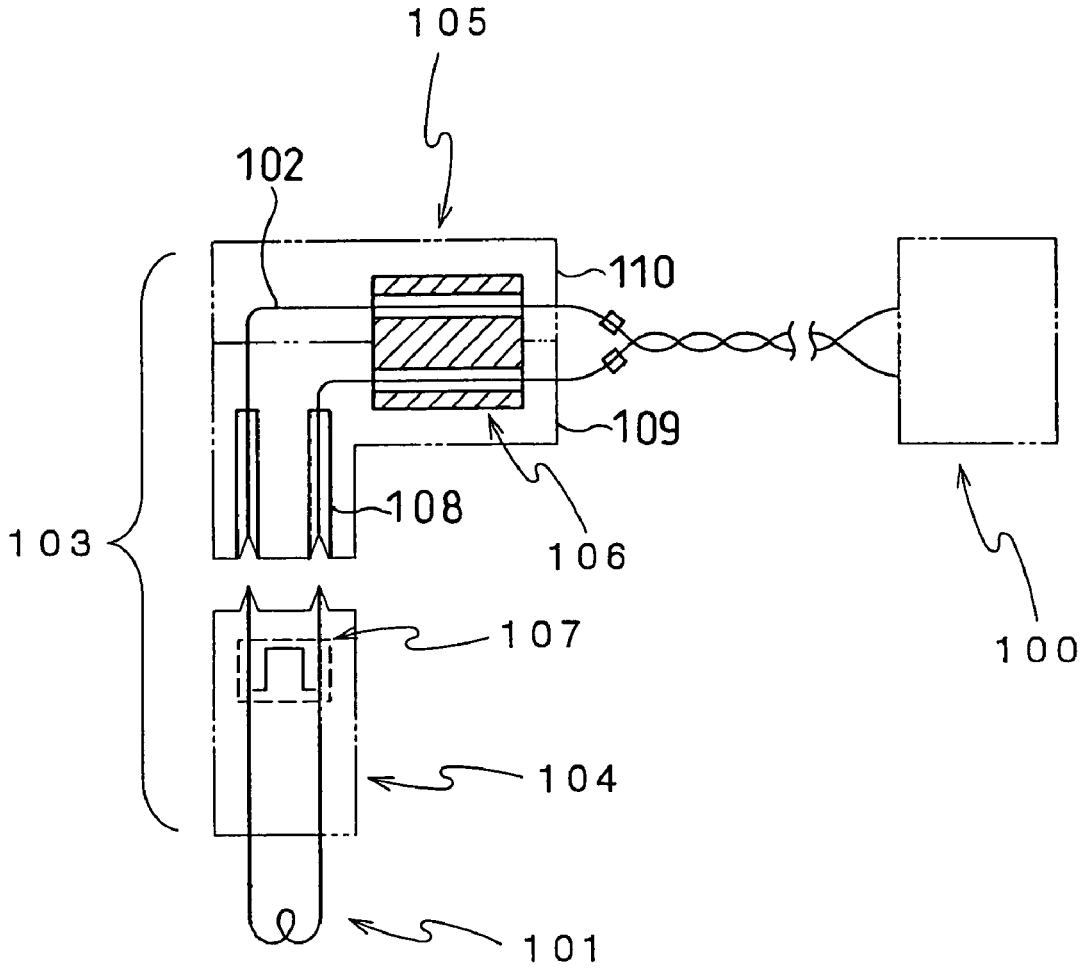
FIG. 13 is a schematic view showing a whole construction of an electric connector used in an airbag system.

The electric connector 1 comprising the socket 2 and the plug 3 is provided as a part of an airbag ignition device (in some cases, called squib) that must be electrically connected to a control system of an airbag system shown in FIG. 13. The ignition device is a pyrotechnic device that burns when a sufficient quantity of electric energy is supplied via two conductors thereof. The ignition device burns whereby a gas generating material is ignited with the result that an airbag is developed.

INDUSTRIAL APPLICABILITY

As apparent from the above description, the plug 3 for electric connectors is particularly suited to application on an airbag system that restrains an occupant in a vehicle. However, a further wide application is possible and application to many different circumstances and various objects is possible.

The invention claimed is:

1. A plug for an electric connector, comprising:

a connection part comprising a contact connected to an end portion of an electric wire;

a noise filter having a through-hole to pass the electric wire therethrough;

a housing provided with a plug portion and configured to accommodate the connection part and the noise filter such that the contact is latched to the plug portion, wherein the housing has an insertion space configured to receive the noise filter inserted in a direction along the electric wire;

a cap configured to be attached to the housing so as to cover the connection part and the noise filter, wherein the cap comprises a wall surface configured to engage a rear end of the noise filter; and a protrusion to engage the noise filter disposed on a surface forming the insertion space of the housing;

wherein at least one rib disposes on an inner surface of the insertion space of the housing to abut against a side of the noise filter.

2. The plug according to claim 1, wherein an outer edge of a front end of the noise filter is chamfered.

* * * * *